US008926041B2

(12) United States Patent
Rosario et al.

(10) Patent No.: US 8,926,041 B2
(45) Date of Patent: Jan. 6, 2015

(54) INK JETTING

(71) Applicants: Timothy Rosario, Enfield, NH (US); Jaan T. Laaspere, Norwich, VT (US); George Baker, Charlestown, NH (US)

(72) Inventors: Timothy Rosario, Enfield, NH (US); Jaan T. Laaspere, Norwich, VT (US); George Baker, Charlestown, NH (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 0 days.

(21) Appl. No.: 13/751,814

(22) Filed: Jan. 28, 2013

(65) Prior Publication Data

US 2014/0210884 A1 Jul. 31, 2014

(51) Int. Cl.
*B41J 29/38* (2006.01)
*B41J 2/045* (2006.01)

(52) U.S. Cl.
CPC ..... *B41J 2/04588* (2013.01)
USPC ..... 347/10

(58) Field of Classification Search
CPC ..... B41J 2/04581; B41J 2/04588; B41J 2/04596; B41J 2/0459; B41J 2/04541
USPC ..... 347/5, 9–14, 48, 57–59, 68, 72
See application file for complete search history.

(56) References Cited

U.S. PATENT DOCUMENTS

| | | | | |
|---|---|---|---|---|
| 5,821,953 | A * | 10/1998 | Nakano et al. | 347/10 |
| 7,311,370 | B2 * | 12/2007 | Kondoh | 347/10 |
| 7,407,246 | B2 | 8/2008 | Vanhooydonck | |
| 7,699,420 | B2 * | 4/2010 | Date et al. | 347/10 |
| 7,926,901 | B2 * | 4/2011 | Ito | 347/19 |
| 7,997,675 | B2 * | 8/2011 | Ishizaki | 347/14 |
| 8,056,999 | B2 * | 11/2011 | Gardner et al. | 347/9 |
| 8,251,471 | B2 | 8/2012 | Fontaine et al. | |
| 8,360,543 | B2 * | 1/2013 | Komatsu et al. | 347/14 |
| 2003/0020772 | A1 | 1/2003 | Morikawa | |
| 2003/0142160 | A1 | 7/2003 | Kobayashi et al. | |
| 2005/0116883 | A1 | 6/2005 | Kondoh | |
| 2005/0168512 | A1 * | 8/2005 | Mochizuki | 347/19 |
| 2008/0198192 | A1 | 8/2008 | Iriguchi | |
| 2011/0050770 | A1 * | 3/2011 | Otokita | 347/11 |

OTHER PUBLICATIONS

International Search Report and Written Opinion, PCT/US2014/013141, mailed May 1, 2014, 11 pages.

* cited by examiner

*Primary Examiner* — Hai C Pham
(74) *Attorney, Agent, or Firm* — Fish & Richardson P.C.

(57) ABSTRACT

Among other things, an inkjet print head module includes inkjets from which ink drops are to be jetted during a series of jetting cycles. There is circuitry on the inkjet print head module to (a) form, from trimming information or other information that characterizes jetting waveforms to be applied to respective inkjets in respective jetting cycles, corresponding jetting waveforms and (b) apply the formed jetting waveforms to the respective inkjets in the respective jetting cycles.

51 Claims, 5 Drawing Sheets

INK JETTING

BACKGROUND

This description relates to ink jetting.

As shown in FIG. 1, in some ink jet printing arrangements, ink drops are jetted by inkjets from a row 12 of nozzles 14 arranged on a bottom surface of an inkjet print head module 16. The drops from each of the nozzles along the row can be jetted toward a corresponding one of a series of nominal spot positions 21 that are spaced evenly along a corresponding line 24 that is parallel to a direction of relative motion 20 between the print head module and a paper or other substrate 18. Lines 24 are perpendicular to a series of nominal print lines 23 that are parallel to the row of nozzles and are evenly spaced along the substrate 18 as the substrate moves relative to the print head module. The jetted ink drops produce ink spots 10 on the substrate in a pattern that forms a printed image 28 that corresponds to an original image 25 of graphics, text, symbols, colors, and a wide range of other elements.

SUMMARY

In general, in an aspect, an inkjet print head module includes inkjets from which ink drops are to be jetted during a series of jetting cycles. There is circuitry on the inkjet print head module to (a) form, based on trimming information or other information that characterizes jetting waveforms to be applied to respective inkjets in respective jetting cycles, corresponding jetting waveforms and (b) apply the formed jetting waveforms to the respective inkjets in the respective jetting cycles.

Implementations may include any of the following features and combinations of any two or more of them. The information characterizes different jetting waveforms to be applied to different respective inkjets. The information characterizes different jetting waveforms each to be applied to all of the inkjets in a corresponding group of the inkjets. The information characterizes each of the jetting waveforms independently of the characterization of any other jetting waveform. The characterizing of the jetting waveform includes identifying a trimming amount to be applied to a basic jetting waveform. The formed jetting waveforms include analog voltage waveforms. Each of the formed jetting waveforms includes a rising period, a plateau period, a declining period, and a rest period before repeating. The plateau period is generally flat and has a magnitude. The generating of the jetting waveforms includes trimming one or more basic waveforms. The trimming includes increasing a baseline value so that a magnitude of the basic waveform relative to the baseline value is reduced by a trimming amount. The trimming amount includes an amount selected from a set of available amounts. The trimming amount is identified by a trimming value. A lookup table associates each of the trimming values with a trimming amount. The lookup table is to be stored in the circuitry on the inkjet print head module. The lookup table contains associations between trimming values and trimming amount to be used in generating the jetting waveforms. There is storage to hold trimming amounts to be used in generating the jetting waveforms. The trimming amounts represent trimming voltages.

There is a communication channel on the print head module to receive information to be used in generating the jetting waveforms. The information to be received includes the information that characterizes the jetting waveforms to be applied to respective inkjets in respective jetting cycles. The information to be received includes jetting cycle triggers. The information to be received includes trimming values that are to be used to identify trimming amounts to be applied in generating the jetting waveforms for the respective inkjets. The information to be received includes trimming amounts to be applied in generating the jetting waveforms for the respective inkjets. The information to be received includes jetting values for the respective inkjets for the respective jetting cycles. The jetting values represent the jetting or non-jetting of ink drops. The circuitry on the inkjet print head module applies the formed jetting waveforms to the respective inkjets in the respective jetting cycles after applying trimming amounts to the jetting waveforms. The circuitry on the inkjet print head module applies the formed jetting waveforms to the respective inkjets in the respective jetting cycles in response to receiving jetting cycle trigger signals. The jetting waveforms are formed from one or more common basic jetting waveforms.

The circuitry on the inkjet print head module includes switches each of which passes one of the jetting waveforms to one of the respective inkjets in one of the respective jetting cycles in response to a jetting cycle trigger signal. The circuitry applies the formed jetting waveforms to piezoelectric actuators of the respective inkjets. There is substrate handling equipment to provide relative motion between the substrate and the inkjet print head module. There is a coupler to carry a communication channel between the inkjet print head module and circuitry off the inkjet print head module. There is a sensor or monitor to determine an expected volume or velocity of an ink drop to be jetted from one of the inkjets, the sensor or monitor being coupled to the circuitry on the inkjet print head module. There are one or more such inkjet print head modules. The circuitry includes an integrated circuit. The inkjet print head module includes one or more inkjet print head modules. The inkjet print head module includes one or more inkjet print modules containing the inkjets and the apparatus includes such circuitry on each of the print head modules. The inkjet print head module is subjected to manufacturing tolerances that are less stringent than a predefined threshold.

In general, in an aspect, an inkjet print head module includes (a) inkjets from which ink drops are to be jetted during a series of jetting cycles, (b) storage to hold information about (i) a common basic jetting waveform to be used in generating jetting waveforms to be applied to respective inkjets in respective jetting cycles, (ii) trimming amounts to be applied to the common basic jetting waveform in generating the jetting waveforms, the trimming amounts being associated with trimming values, (iii) trimming values, and (iv) jetting values each indicating whether to jet an ink drop from a respective one of the inkjets in a respective one of the jetting cycles, and (c) a coupler to carry the information to be held on the storage from an external source onto the inkjet print head module.

Implementations may include one or more any of the following features and combinations of any two or more of them. The storage includes read-only memory. The inkjet print head module includes circuitry to apply jetting waveforms to respective inkjets in respective jetting cycles based on the common basic jetting waveform, the trimming amounts, the trimming values, and the jetting values. The coupler carries jetting cycle trigger signals.

In general, in an aspect jetting waveform trimming information is formed that corresponds to respective inkjets of an inkjet print head module for respective jetting cycles. The jetting waveform trimming information is sent from an external location to storage located on the inkjet print head module. Jetting cycle trigger signals are sent from an external location to the inkjet print head module to trigger successive jetting cycles in each of which jetting waveforms based on the jetting waveform trimming information are applied to the respective inkjets.

Implementations may include one or more any of the following features and combinations of any two or more of them. The jetting waveform trimming information is formed based on information about ink drops to be jetted from the respective inkjets. The information about ink drops is generated empirically. The jetting waveform trimming information includes nominal trimming values representing different respective amounts of trimming. The jetting waveform trimming information includes trimming amounts representing respective different amounts of voltage by which to trim jetting waveforms. The jetting waveform trimming information includes separate information for each of the inkjets for each of the jetting cycles. The jetting waveform trimming information includes separate information for respective sets of the inkjets. The jetting waveform trimming information is sent to the storage located on the inkjet print head module at least once during the manufacture of the inkjet print head module. In some cases, the jetting waveform trimming information is sent to the storage located on the inkjet print head module as often as before each print job. At least some of the jetting waveform trimming information is sent to the storage located on the inkjet print head module at least as often as each print job. At least some of the jetting waveform trimming information is sent to the storage located on the inkjet print head module from time to time. The jetting waveform trimming information includes a lookup table that associates nominal trimming values with amounts of trimming voltage.

In general, in an aspect, different jetting waveforms can be applied to different inkjets of an inkjet head module to improve the uniformity of jetting among the inkjets. Manufacturing tolerances for at least one component part of the inkjet head module can be set based on the improved uniformity.

Implementations may include one or more any of the following features and combinations of any two or more of them. The jetting waveforms are generated other than on the print head module and are loaded into memory on the print head module. The jetting waveforms are enabled or trimmed or both in the integrated circuit on the print head module.

These and other aspects, features, implementations, and combinations of them, can be expressed as methods, apparatus, systems, components, software products, methods of doing business, means or steps for performing functions, and in other ways.

These and other aspects, features, implementations, and advantages will become apparent from the following description, and from the claims.

DESCRIPTION

Figure 1:
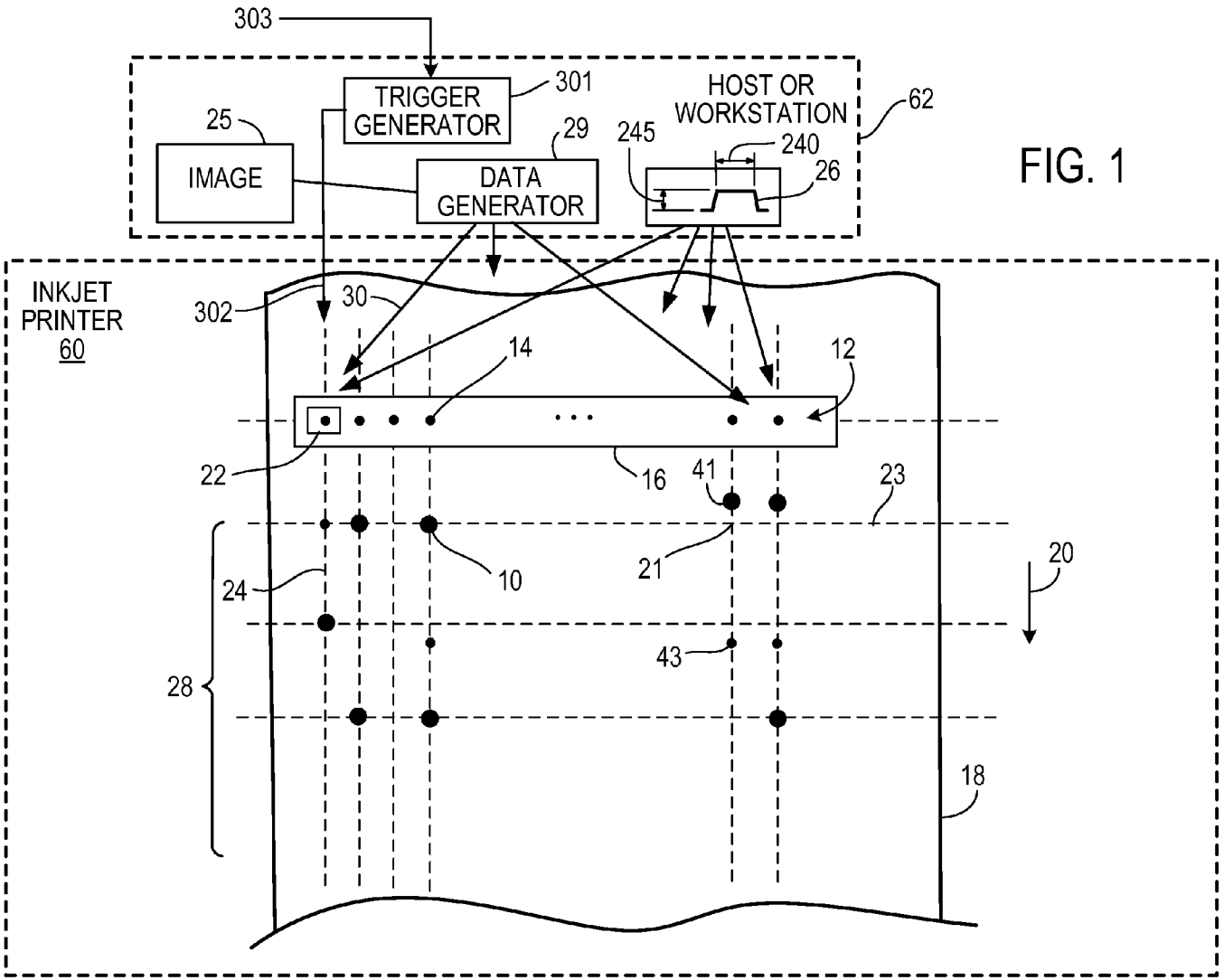
FIG. 1 is a top schematic view of inkjet printing.

Referring again to FIG. 1, the jetting of ink drops to form ink spots 10 at spot positions 21 along a given print line 23 can be thought of as occurring in a so-called jetting cycle. A complete ink spot can be formed on the substrate by jetting one, two, or more than two ink drops toward the intended spot position. When two or more ink drops are jetted in a jetting cycle, the ink in the drops combines at the spot position to form the intended ink spot. A series of successive jetting cycles therefore can correspond to a single nominal print line 23. The printing of each of the print lines occurs during a so-called line-printing cycle, which therefore can span one, two, or more than two jetting cycles.

To cause the ink spots 10 to be formed by the jetted ink drops at the proper spot positions to produce the intended printed image, a jetting data generator 29 produces jetting data 30 corresponding to the original image 25. The jetting data can include a jetting value for each of the inkjets of the inkjet print head module and for each of the jetting cycles. A jetting value could, for example, specify whether an ink drop should be jetted from a given inkjet at a given print line in a given jetting cycle.

An ink drop can be jetted from an inkjet by temporarily reducing (squeezing) the volume of a pumping chamber 22 in the inkjet to force ink in the chamber to be ejected from a nozzle 14 during the jetting cycle. In some examples, the pumping chamber is squeezed by a piezoelectric actuator when a jetting voltage waveform 26 is applied to the actuator. Based on the jetting data 30, the jetting voltage waveform is applied to the actuator depending on the jetting value for the inkjet for the jetting cycle. The jetting voltage is applied at a time determined by a jetting trigger signal 302. The jetting trigger signal is produced by a trigger generator 301 and indicates, for example, the start of the jetting cycle based on information 303 indicating that a corresponding nominal print line on the moving substrate is in a position relative to the print head module for printing a line that corresponds to the jetting cycle.

In other words, when a jetting trigger signal indicates the occurrence of a jetting cycle and a jetting value indicates that a given inkjet is to eject a drop, a jetting voltage waveform is applied to that inkjet. By applying jetting voltage waveforms to inkjets that have been identified by jetting values in each of a series of jetting cycles while the substrate moves relative to the inkjet print head module for succeeding print cycles, the printed image can be formed on the substrate.

Figure 2:
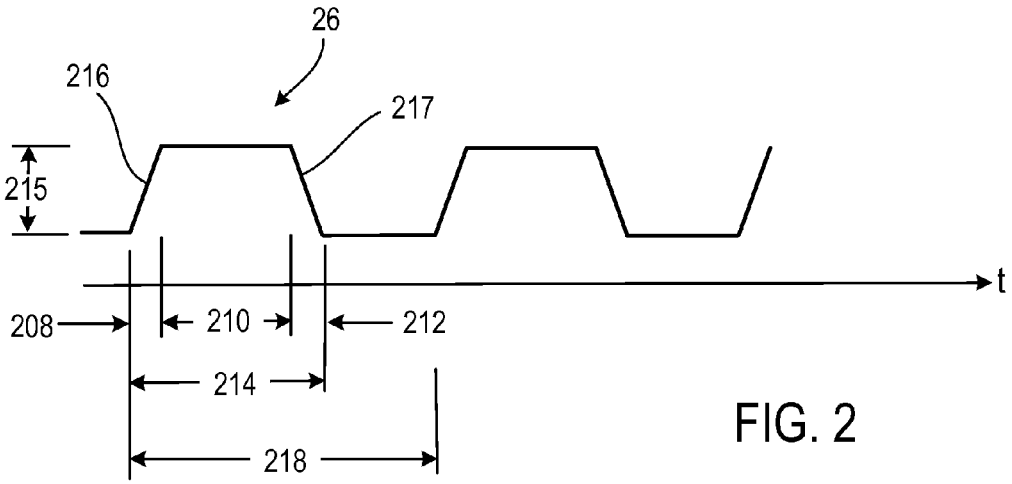
FIG. 2 is a diagram of waveforms.

As shown in FIG. 2, a jetting voltage waveform 26 can have a wide variety of profiles. Typical jetting voltage waveforms have a profile that includes a first period 208 in which the voltage rises quickly, a second period 210 in which the voltage is at a plateau level (flat and horizontal, in some cases) representing a magnitude of the waveform, and a third period 212 in which the voltage declines quickly to its original value. Five key parameters of a jetting voltage waveform are its duration 218 from beginning to end, its magnitude 215, the slew rate (slope) 216 of the first, rising period, the slew rate (slope) 217 of the final, declining period, and the frequency of appearance of the jetting voltage waveforms (the inverse of period 218), that is, the frequency of jetting cycles.

One goal in designing, manufacturing, and operating of some inkjet print head modules and assemblies of modules is that every inkjet within an inkjet print head module and from module to module in a print head assembly and from assembly to assembly in a printer will eject ink drops having the same volume and velocity over time. Then the ink spots that result from the jetting of ink drops from any of the inkjets, when driven by the same jetting voltage waveform, will be formed in the intended nominal spot positions on the substrate, and all ink spots will have the same size and shape.

For many reasons, however, this goal is hard to achieve. The ink spots 41, 43 formed on the substrate may vary from the intended size and shape and may not be located in the intended spot positions, as illustrated by some of the spots shown in FIG. 1. Some causes of the variability relate to manufacturing variations in the configurations of the pumping chambers, nozzles, and piezoelectric elements. Other causes include variations in ink characteristics, operating variations of individual inkjets over time and among different inkjets, drying of ink in the inkjet nozzles, changes in ambient air temperature and ink temperature, the frequency of the jetting cycles, or speed of the substrate, the profiles of the jetting voltage waveforms and others. These factors can affect, among other things, the volumes and velocities of ink drops that are jetted, the volumes and velocities, among other parameters, affect the sizes, shapes, and locations of the spots on the substrate that result from the jetting.

To improve the uniformity of jetting among many inkjets and over time, each of the five key parameters of the jetting voltage waveform may be controlled separately to regulate the volumes and velocities of the drops being jetted.

In some implementations of the system that we are describing, the waveform magnitude (the voltage at the plateau 215) is the main parameter that is controlled to influence the volume, the velocity, or both, of the ink jetting for a given jetting cycle frequency. In some other cases, when the jetting cycle frequency is to be changed, the waveform magnitudes can be changed also.

By controlling the magnitude of the jetting voltage waveform delivered to a given inkjet in a given jetting cycle independently of the waveform used for any other inkjet or for any other jetting cycle or both the uniformity of jetting or a variety of other purposes can be served. (In some implementations, the magnitude of the waveform can be controlled to a given common level for a group of two or more but fewer than all of the inkjets in the inkjet print head module.) In any case, the magnitude of the waveform for each inkjet (or each group) may be controlled to have any one of a set of different values, such as two, four, eight, or sixteen or thirty-two (or any other number) different values.

Figure 3:
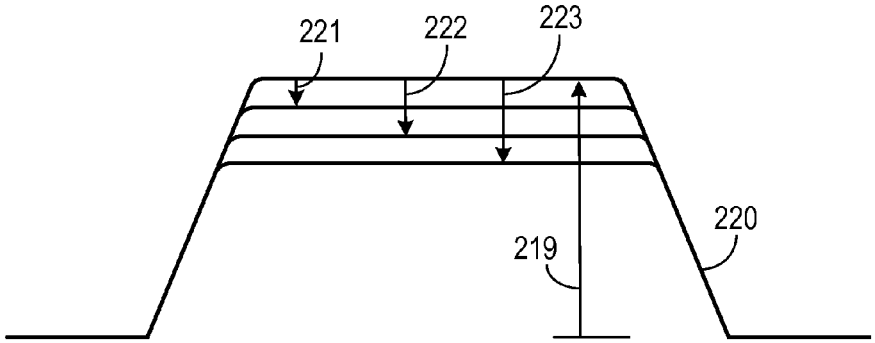
FIG. 3 is a diagram of waveforms.

As shown in FIG. 3, one way to control the magnitudes of the jetting voltage waveforms on a per-jet, per-group, and per-jetting-cycle basis is to form each of them from a common basic voltage waveform 220 that has a predetermined magnitude 219 and then to trim (e.g., reduce) the effective magnitude of the basic voltage waveform to be applied to the piezoelectric element by a selected one of one or more trimming amounts of voltage 221, 222, 223 for individual inkjets (or groups of them). As noted, although the system is capable of applying trimming amounts to the waveform on a per-jet and per-cycle basis, in some examples, the same trimming amounts can be applied in common to sets of jets in a given jetting cycle or to a given inkjet across sets of cycles or to combinations of the two.

FIG. 3 is a conceptual illustration of the relationship of the effective magnitude of the trimmed voltage waveform to be applied to the piezoelectric element to the magnitude of the untrimmed basic waveform. In some cases, the trimming of the effective magnitude is done by first arranging the basic waveform to be, for example, 70V above ground. The level of ground is then changed from 0 (to retain the full magnitude of the basic waveform without trimming) to a selected value that is higher than 0V and up to about 20V to effect the trimming of the effective magnitude from its starting value (say, 70V) to −20V from that starting value (that is, 50V in our example). The voltage waveform that is produced at the output of the trimming circuit is therefore a signal between from 50V and 70V that tracks the input untrimmed basic waveform. The trimming value causes the ground reference to be lifted, making the effective voltage across the piezoelectric element smaller.

Figure 4:
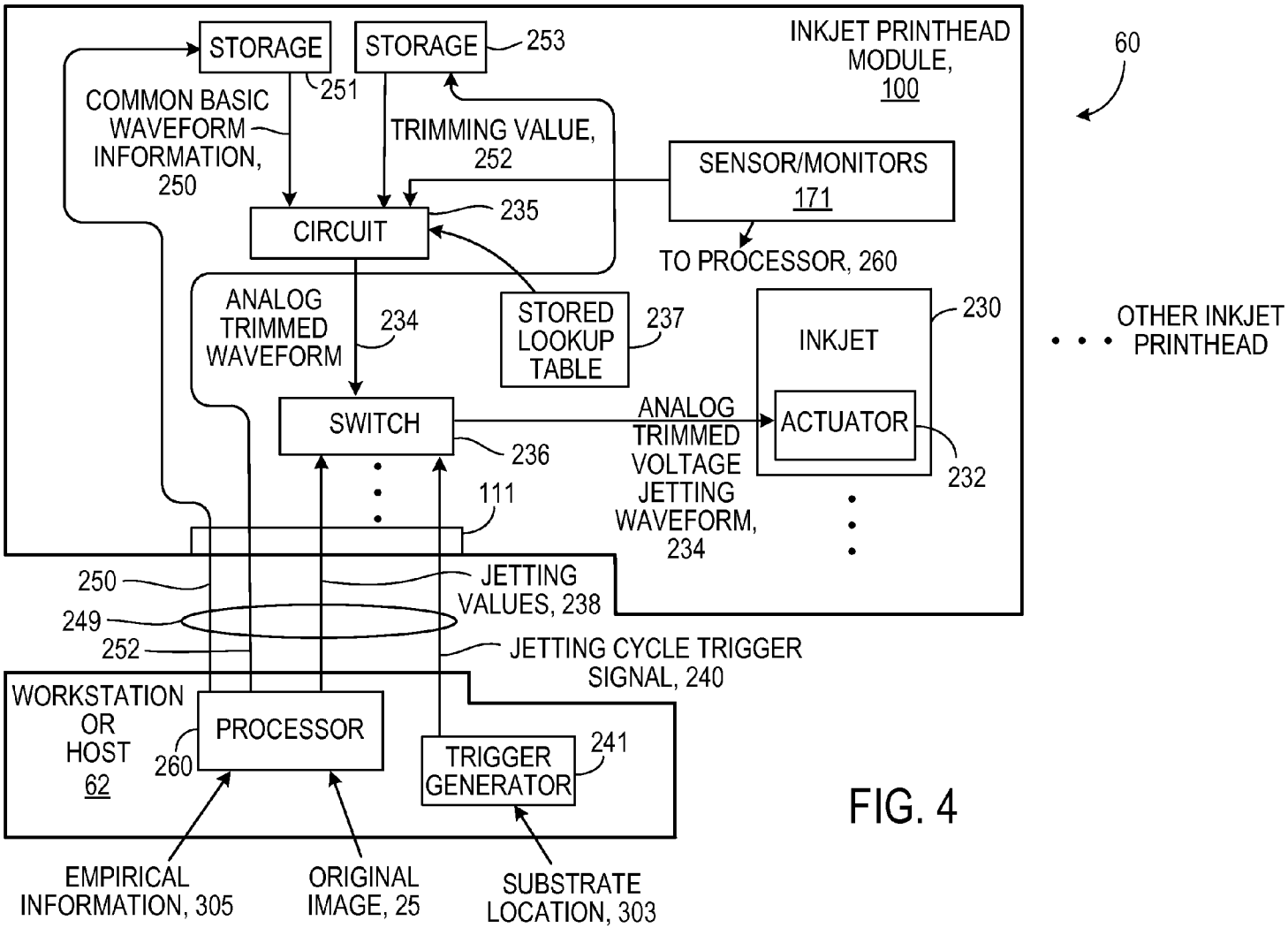
FIG. 4 is a block diagram.

As shown in FIG. 4, the jetting voltage waveforms are applied to the actuators 232 of the inkjets 230 as analog voltage profiles 234. In some examples, the waveforms 234 are applied by switches 236 one for each of the inkjets 230 to be served. Each switch applies (or refrains from applying) the trimmed jetting voltage waveform 234 to an inkjet actuator 232 in a jetting cycle based on three inputs: the analog trimmed jetting voltage waveform 234, the jetting value 238 for the inkjet (indicating whether ink should or should not be jetted from that inkjet in that jetting cycle), and a jetting cycle trigger signal 240 that indicates the occurrence (for example, the start of) the jetting cycle. Each switch delivers the trimmed jetting voltage to the inkjet in response to the trigger signal if the jetting value indicates that the inkjet should be actuated.

The analog trimmed jetting voltage waveform 234 that is used by the switch can be generated or formed by a circuit 235 (e.g., a processor that forms the waveform and that may also apply the trimmed waveforms to drive the piezoelectric elements of the inkjets) in a variety of ways using information that defines the common basic voltage waveform 250 and information that specifies the trimming values 252 to be used for individual inkjets or groups of them. The trimming values 252 represent amounts by which the plateau voltage (magnitude) 219 of the waveform is to be, for example, reduced. In some cases, trimming values can be provided for each inkjet for each jetting cycle. The trimming values could be provided, for example, serially from the workstation fast enough to keep up with a high frequency of jetting cycles. Circuits 235 use the trimming values to generate the jetting voltage waveforms from the common basic voltage waveform. In some cases, trimming values can be provided for sets of inkjets or for sets of jetting cycles or for combinations of the two. The circuits 235 can include digital to analog circuitry to enable them to form the analog voltage waveforms from digital input information.

The common basic jetting voltage waveform information 250 can take a variety of forms, including data defining the slew rates, magnitude, duration of the waveform, or pointers to tables in which the information is stored, or other forms. In some cases the data comprise digital values that represent the profile of the waveform. The trimming values can take the form of data used to look up voltage values in a look up table, or data that expresses the voltage trimming values directly, or could take other forms. The jetting values can take the form of binary flags (indicating whether to jet or not) and can include other information related to jetting. The jetting cycle trigger signal 240 can be in the form of a data signal or an analog trigger or other forms.

In various implementations of the system, the trimming values 252, the jetting values 238, the common basic waveform information 250, and the triggering signals 240 can be generated, stored, delivered, received, and used by a variety of circuits, storage devices, processors, and communication channels and combinations of them located in and distributed among the printer, the print heads, the work station, or in other places or combinations of them depending on design, manufacturing, and operating considerations of particular applications. The number of electronic devices provided to do these functions, the places where they are located, how they are interconnected, how the functions are divided among them, and other aspects of the electronics of the system are subject to a wide variety of design considerations, including bandwidth, speed and frequency of operation, size, number of inkjets and heads, cost, and adaptability to the needs of different customers. These design considerations can lead to a wide variety of implementations.

The jetting values can be derived by a processor 260 from the original image 25, for example by translating digital values that represent the image in a common format such as *.tiff into other digital values that are native to the printer, if necessary. The common basic waveform information, however represented, can be produced during design and manufacture and held in storage 251. The waveform information can be loaded into the memory prior to delivery to a customer (for example, the information can be loaded only once, at the time of manufacture), or at a later time, or can be updated from time to time, for example, before one or more print jobs, or at other times. The trimming values for inkjets and groups of them can be formed during design and manufacture and held in storage 253. The trimming values can be developed empirically and stored in storage 253 prior to delivery to a customer to be suitable for the print head modules in the printer that is being served. The trimming amounts (the actual trimming voltages) can be developed empirically and stored in storage 253 prior to delivery to a customer to be suitable for the print head modules in the printer being served. Trimming amounts can be updated from time to time to suit new applications or new information about the print head modules. The triggering signals can be generated by a trigger generator 241 during printing based on information 303 about the location of the substrate (and the nominal printing lines) relative to the print head.

Figure 5:
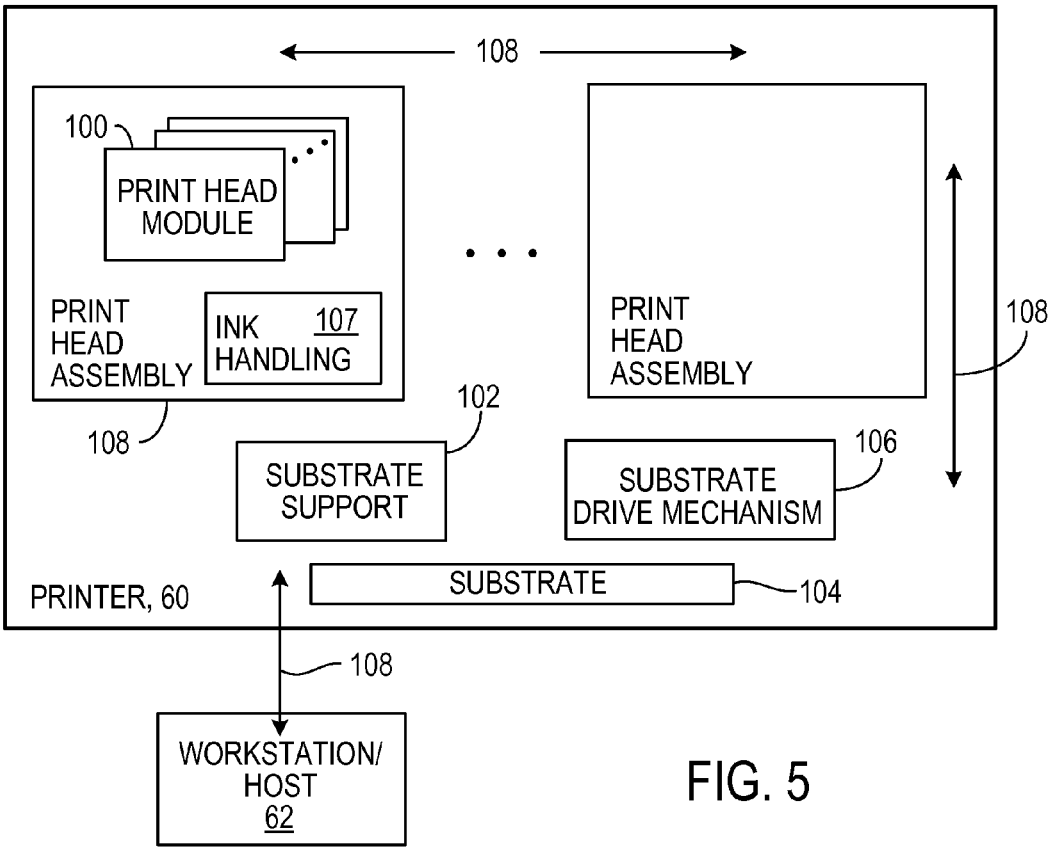
FIG. 5 is a block diagram

As shown in FIG. 5, an inkjet printer 60 can contain one or more inkjet print head modules 100. One or two or more sets of print head modules can be served by ink handling devices 107 that include ink reservoirs 107. The modules 100, the ink handling devices 107, and other elements can be assembled in units called print head assemblies or print heads 108. One or two or more print heads can be included in a printer 104 along with a support 102 for the substrate 104, a mechanism 106 to move 20 the substrate and the inkjet print heads relative to one another, communication channels 108 to carry values, data, information, and signals to and from the outside world and within the printer, and a variety of other components. When we refer to an inkjet printer, we mean, for example, a device that receives ink, a substrate, and signals, data, and other information and uses them to print images on the substrate.

Figure 6:
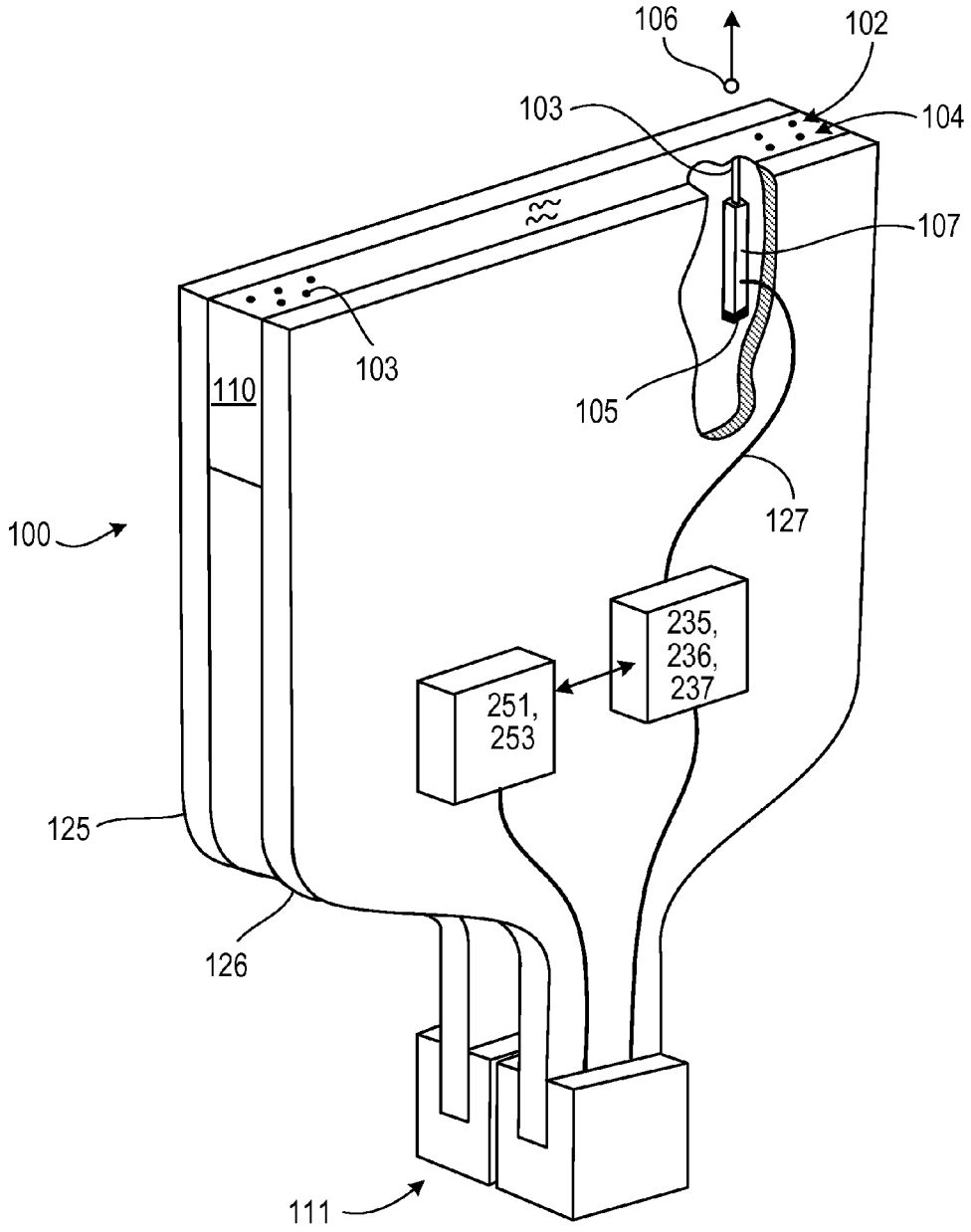
FIG. 6 is an isometric view of an inkjet print head module.

As shown in FIG. 6, each inkjet print head 100 typically includes one or more rows 102, 104 (or other arrangements) of inkjets each of which includes a nozzle 103 from which ink drops 106 are jetted toward the spot positions on the substrate. A pumping chamber 105 pumps the ink in small amounts through the nozzle, and an actuator 107 (for example a piezoelectric actuator) "squeezes" the pumping chamber to cause a small amount of ink to be pumped in response to a jetting voltage waveform. The number of inkjets on the inkjet print head can be as few as ten or a hundred and as many as a thousand or many thousands.

In the example of FIG. 6, a central body 110 contains two rows of nozzles. Corresponding flex circuits 125, 126 are mounted on the two sides of the central body to hold storage 251, 253, driver/trimming chips, circuits, processors, and switches 235, 236, 237, and conductors 127 that can carry trimmed analog waveforms to the actuators of the inkjets. Only one side of the inkjet print head is shown in FIG. 6; the other side includes similar storage, driver/trimming chips, circuits, processors, switches, and conductors. An electronic coupler 111 serves as a port for communication channels through which values, data, information, and signals can be passed onto and from the inkjet print head.

The print head module or print head assembly can include other circuit boards, ink chambers, mounting and alignment structures, other circuitry and storage devices, and other elements in various combinations.

An inkjet head module or an inkjet head assembly can be replaced or serviced by disconnecting its electronic coupler 111 and mechanically disconnecting it from the printer. The print heads of the printer can be arranged end to end in a row to handle wide substrates, can be staggered in adjacent rows to increase the effective printing resolution along the print lines, or can be dedicated to printing different colors separately or overlaid to create a full gamut of colors, for example, or combinations of any two or more of those arrangements. For these purposes and others, a broad range of arrangements can be used to mount the print heads in the inkjet printer and to align and space them relative to one another.

When two or more print head modules are to be coupled to form a print head assembly, they can be mounted in a common collar that enables precise alignment while permitting the print heads to be removed, serviced, or replaced easily. The print head modules and the collar are together can form the print head assembly. Multiple print head assemblies can then be mounted on a bracket or other frame or mounting structure within the inkjet printer.

When a print head module is replaced by another one in the printer, the storage of the replacement print head module can be preloaded with trimming values or trimming amounts or a look up table or any combination of them so that the inkjets of the module will produce ink drops of a volume and velocity that matches the volumes and velocities of other print head modules in the assembly or in the printer. Higher uniformity of printing across inkjets and over time can be served in that way.

Referring again to FIG. 4, the processor 260 that generates the jetting values 238 (also numbered 30 in FIG. 1) from the original image 25 can be located in a workstation or host 62 outside of the printer. The jetting values can then be delivered to storage 251 on the print head module through conductors of a cable 249 that provides the communication channels. The jetting cycle trigger signals can be produced by a trigger generator 241 in the workstation or host 62 and delivered by the cable 249 to the switches 236.

Trimming values 252 can be generated by the processor 260 and delivered through the cable to the storage 253 (for example read-only memory). Enough trimming values can be held in the storage 253 to enable the volume or velocity or both of the ink drops jetted from each of the inkjets to be controlled independently of the volume or velocity, or both, of the ink drop jetted from each other inkjet in a given jetting cycle and in successive jetting cycles, and to do so for a large number of inkjets and for a high frequency of jetting cycles as represented by a high frequency of jetting cycle trigger signals. For example, the storage 253 may have a capacity to hold 128 trimming values to permit as many as 128 inkjets at a jetting cycle frequency as high as 125 kHz. In some implementations the number of trimming values could be any number in a range from 32 to 128 and the jetting cycle frequency would be in the range of 1 kHz to 80 kHz. The maximum update rate when providing trim values on every jetting cycle trigger depends on the maximum frequency of the clock that drives data into the digital-to-analog for each trimming circuit. There is also a settling time for the DAC that must support this update rate.

In some cases, the storage element has the capacity to provide individual trimming values for all of the inkjets on the print head, in this example, 128 inkjets. In some examples, the circuitry 235 that trims the voltage waveforms and drives the piezoelectric elements may have the capacity only to deliver a smaller number of different voltage waveforms to the inkjets in a given jetting cycle, and therefore delivers each of at least one of the waveforms to more than one of the inkjets at one time. For example, the circuitry 235 may be arranged to have four driver circuits or driver chips each of which is connected to provide a single trimmed waveform to 32 of the 128 inkjets on the print head.

The trimming values that are provided to the printer can be specified based on the jetting behaviors of inkjets of a printer that can be characterized empirically under various conditions at the time of manufacture or setup or in between printing jobs or a combination of them. For example, one inkjet may jet larger volume ink drops than another inkjet when the same waveform is applied to the actuators of both inkjets. Using the empirical information, trimming values that define trimmed jetting voltage waveforms that will achieve selected goals, such as less variation of spot size and spot location, can be designed and stored for use during printing.

If the trimming values are stored in memory and applied at the start of a print line, the trim value for a given inkjet would be the same for all jetting cycles that occur for that print line. If trimming values are updated for every jetting cycle, then the trimming values for respective jetting cycles for a given inkjet could be different from one another. The latter approach would permit waveforms to be designed to better maintain the integrity of the multiple jetting cycles and the effects on drops jetted in the respective jetting cycles. The successive waveforms that may occur in success jetting cycles for a given print line can be thought of as a multi-pulse waveform that causes the jetting of multiple droplets from a given inkjet for a given line.

The ability to provide different trimming values for respective pulses of a multi-pulse waveform provides useful advantages. For example, there can be frequency response, crosstalk, or image specific variations that can be handled more effectively at the individual pulse level than if all of the pulses for a given print line were required to use the same trimming values. In addition, the quality and characteristics of drop formation are strongly correlated to the ratios of the magnitudes of the respective pulses and can be controlled by controlling the ratios to achieve desired goals.

In some cases, the circuitry 235 uses a stored look up table 237 to access the amount of voltage by which to trim the magnitude of the basic common voltage waveform for each inkjet. In some examples, the voltage reduction in the magnitude can be between 0 and 20 Volts, in thirty-two increments of 0.64 Volts. A wide variety of other ranges and increments are possible.

The processor in the workstation or host 62 can store the voltage trimming amounts in the look-up table 237. The lookup table holds voltage trimming amounts in a table opposite trimming values so that the circuit 235 can present a trimming value (for example a number between 1 and 32) to the look-up table 237 and receive back the amount of voltage by which the magnitude should be trimmed (for example, a number between 0 and 20 Volts). By using a look-up table the system is therefore able to separate the amounts of voltage trimming from the values that identify abstractly the relative amounts of trimming to be done.

In some cases, the voltage trimming amounts held in the storage 237 may be a single set of values. In some cases, the voltage trimming amounts can include more than one set of values corresponding to different printing conditions. The voltage trimming amounts can be updated in the look-up table storage frequently, for example, each time the printer is powered up.

As mentioned earlier, in some examples, to determine the trimming values that should be applied to the common basic jetting voltage waveform for a given inkjet in a given jetting cycle under a given printing condition, information can be generated before printing or during printing from which the characteristics of the ink drops that will be jetted or are being jetted can be determined or inferred. This information can be used in defining appropriate voltage trimming amounts prior to printing or during printing or both.

In some cases, information for this purpose can be generated during printing by sensors or monitors 171 that can include, for example, a thermometer that measures the temperature of a portion or all of a print head, a drop monitor, an image monitor, or a combination of these or other inkjet printing monitors. Sensors and monitors 171 can detect changes in printing conditions and send information about those changes to the processor 260 or to the circuit 235 or to both. Adjustments could be made for every jetting print cycle in some cases.

In some implementations, prior to printing, the common basic jetting waveform information and the trimming values to be used during printing are downloaded by the processor 260 to the storage 251, 253 located on the print head. Before the start of each jetting cycle, a jetting value for each of the inkjets in the printer is loaded into a corresponding one of the switches 236. The jetting values can be loaded serially into the switches and held by the switches until a jetting cycle trigger signal is received indicating the beginning of the jetting cycle. The trigger signals are generated at the frequency at which the jetting cycles are to occur and are delivered to each print head module through a conductor of the coupler 111. The timing of the trigger signals can be coordinated with the location of the substrate relative to the inkjet print head based on information 303 received from a shaft angle encoder, for example, that senses rotation of a substrate driving element.

After each jetting cycle, a new set of jetting values are loaded serially into the switches. When the next trigger signal appears, the trimmed waveform is delivered by the appropriate switches to the corresponding inkjets. This process is repeated to cause the printing of each print line and successive print lines along the substrate to form the image.

In some implementations, as explained, the trimming values cause a reduction in the magnitude of the basic common jetting waveform, but a wide variety of other approaches can be used, including trimming jetting voltage waveforms that have time-dependent profiles that are more complex and causing trimming by voltage amounts that vary over the duration of a single jetting voltage waveform.

In some implementations the circuitry on each of the modules could be acquired in the form of an integrated circuit from a source such as a version of the model HV5722 32-channel serial to parallel converter with open drain outputs available from SuperTex of Sunnyvale, Calif. The integrated circuit could contain the switches and digital to analog conversion circuitry (e.g., the circuit and switch 235 and 236 shown in FIG. 4) suitable for generating and applying the jetting waveforms to the inkjets. Each integrated circuit could be arranged to handle 32 inkjets and can contain 32 trimming value latches and 32 switches.

Other embodiments are within the scope of the following claims.

A wide variety of techniques, components, and architectures, in addition to or in combination with the ones described here, could be used to provide driving voltage profiles to inkjets in a printer on a per-jet and per-jetting-cycle basis from circuitry in the printer or on the inkjet modules and on the inkjet assemblies or heads. The driving voltage profiles could be complex. Different profiles could be used at different times and for different inkjets. Trimming could be done in other ways that involve more complex or different adjustments of driving voltage profiles. Information to achieve the trimming could be stored in a variety of places on and off the modules and assemblies and within and outside the printer.

The invention claimed is:

1. An apparatus comprising:

an inkjet print head module including inkjets configured to jet ink drops, and circuitry on the inkjet print head module to (a) modify a basic waveform, based on trimming information or other information that characterizes jetting waveforms to be applied to respective inkjets, to generate jetting waveforms and (b) for each jetting waveform, apply the jetting waveform to its respective inkjet, wherein:

the basic waveform comprises a baseline voltage and a plateau voltage that are separated from each other by a voltage having a relative magnitude, the baseline voltage of the basic waveform preceding the plateau voltage of the basic waveform;

for each jetting waveform, the jetting waveform comprises a baseline voltage and a plateau voltage that are separated from each other by a voltage having a relative magnitude, the baseline voltage of the jetting waveform preceding the plateau voltage of the jetting waveform; and modifying the basic waveform to generate the jetting waveforms comprises reducing the relative magnitude of the voltage between the baseline voltage and the plateau voltage of the basic waveform by increasing the baseline voltage so that, for each jetting waveform, the relative magnitude of the voltage between the baseline voltage and the plateau voltage of the jetting waveform is less than the relative magnitude of the voltage between the baseline voltage and the plateau voltage of the basic waveform by a trimming amount; and for each jetting waveform, applying its plateau voltage to its corresponding inkjet causes the corresponding inkjet to jet an ink drop.

2. The apparatus of claim 1 in which the information characterizes different jetting waveforms to be applied to different respective inkjets.

3. The apparatus of claim 1 in which the information characterizes different jetting waveforms each to be applied to all of the inkjets in a corresponding group of the inkjets.

4. The apparatus of claim 1 in which the information characterizes each of the jetting waveforms independently of the characterization of any other jetting waveform.

5. The apparatus of claim 1 in which the characterizing of the jetting waveform comprises identifying a trimming to be applied to the basic waveform.

6. The apparatus of claim 1 in which the generated jetting waveforms comprise analog voltage waveforms.

7. The apparatus of claim 6 in which each of the generated jetting waveforms includes a rising period, a plateau period, a declining period, and a rest period before repeating.

8. The apparatus of claim 7 in which the plateau period is generally flat and has a magnitude.

9. The apparatus of claim 1 in which the trimming amount comprises an amount selected from a set of available amounts.

10. The apparatus of claim 1 in which the trimming amount is identified by a trimming value.

11. The apparatus of claim 10 comprising a lookup table that associates each of the trimming values with a trimming amount.

12. The apparatus of claim 11 in which the lookup table is to be stored in the circuitry on the inkjet print head module.

13. The apparatus of claim 1 comprising a lookup table to be stored on the print head module and containing associations between trimming values and trimming amounts to be used in generating the jetting waveforms.

14. The apparatus of claim 1 comprising storage to hold trimming amounts to be used in generating the jetting waveforms.

15. The apparatus of claim 14 in which the trimming amounts represent trimming voltages.

16. The apparatus of claim 1 comprising a communication channel on the print head module to receive information to be used in generating the jetting waveforms.

17. The apparatus of claim 16 in which the information to be received comprises the information that characterizes the jetting waveforms to be applied to respective inkjets in respective jetting cycles.

18. The apparatus of claim 16 in which the information to be received comprises jetting cycle triggers.

19. The apparatus of claim 16 in which the information to be received comprises trimming values that are to be used to identify trimming amounts to be applied in generating the jetting waveforms for the respective inkjets.

20. The apparatus of claim 16 in which the information to be received comprises trimming amounts to be applied in generating the jetting waveforms for the respective inkjets.

21. The apparatus of claim 16 in which the information to be received comprises jetting values for the respective inkjets for respective jetting cycles, the jetting values representing the jetting or non jetting of ink drops.

22. The apparatus of claim 1 in which the circuitry on the inkjet print head module applies the generated jetting waveforms to the respective inkjets in respective jetting cycles after applying trimming amounts to the jetting waveforms.

23. The apparatus of claim 1 in which the circuitry on the inkjet print head module applies the generated jetting waveforms to the respective inkjets in respective jetting cycles in response to receiving jetting cycle trigger signals.

24. The apparatus of claim 1 in which the circuitry is configured to generate additional jetting waveforms by modifying additional basic waveforms.

25. The apparatus of claim 1 in which the circuitry on the inkjet print head module comprises switches each of which passes one of the jetting waveforms to one of the respective inkjets in a respective jetting cycle in response to a jetting cycle trigger signal.

26. The apparatus of claim 1 in which the circuitry applies the generated jetting waveforms to piezoelectric actuators of the respective inkjets.

27. The apparatus of claim 1 comprising substrate handling equipment to provide relative motion between the substrate and the inkjet print head module.

28. The apparatus of claim 1 comprising a coupler carrying a communication channel between the inkjet print head module and circuitry off the inkjet print head module.

29. The apparatus of claim 1 comprising a sensor or monitor to determine an expected volume or velocity of an ink drop to be jetted from one of the inkjets, the sensor or monitor being coupled to the circuitry on the inkjet print head module.

30. The apparatus of claim 1 comprising one or more additional such inkjet print head modules.

31. The apparatus of claim 1 in which the circuitry comprises an integrated circuit.

32. The apparatus of claim 1 in which the inkjet print head module comprises one or more inkjet print head modules.

33. The apparatus of claim 1 in which the inkjet print head module comprises one or more inkjet print modules containing the inkjets and the apparatus comprises such circuitry on each of the print head modules.

34. The apparatus of claim 1 in which the circuitry is configured to only reduce the relative magnitude of the voltage between the baseline voltage and the plateau voltage of the basic waveform.

35. An apparatus comprising:

an inkjet print head module comprising (a) inkjets configured to jet ink drops, (b) storage to hold information about (i) a basic waveform to be used in generating jetting waveforms to be applied to respective inkjets in respective jetting cycles, (ii) trimming amounts to be applied to the basic waveform in generating the jetting waveforms, the trimming amounts being associated with trimming values, (iii) trimming values, and (iv) jetting values each indicating whether to jet an ink drop from a respective one of the inkjets in a respective one of the jetting cycles, (c) a coupler to carry the information to be held on the storage from an external source onto the inkjet print head module, and (d) a circuitry configured to modify the basic waveform to generate the jetting waveforms, wherein:

the basic waveform comprises a baseline voltage and a plateau voltage that are separated from each other by a voltage having a relative magnitude, the baseline voltage of the basic waveform preceding the plateau voltage of the basic waveform;

for each jetting waveform, the jetting waveform comprises a baseline voltage and a plateau voltage that are separated from each other by a voltage having a relative magnitude, the baseline voltage of the jetting waveform preceding the plateau voltage of the jetting waveform; and modifying the basic waveform to generate the jetting waveforms comprises reducing the relative magnitude of the voltage between the baseline voltage and the plateau voltage of the basic waveform by increasing the baseline voltage so that, for each jetting waveform, the relative magnitude of the voltage between the baseline voltage and the plateau voltage of the jetting waveform is less than the relative magnitude of the voltage between the baseline voltage and the plateau voltage of the basic waveform by a trimming amount; and for each jetting waveform, applying its plateau voltage to its corresponding inkjet causes the corresponding inkjet to jet an ink drop.

36. The apparatus of claim 35 in which the storage comprises read-only memory.

37. The apparatus of claim 35 in which the circuitry is configured to apply the jetting waveforms to respective inkjets in respective jetting cycles based on the basic waveform, the trimming amounts, the trimming values, and the jetting values.

38. The apparatus of claim 35 in which the coupler carries jetting cycle trigger signals.

39. The apparatus of claim 35 in which the circuitry is configured to only reduce the relative magnitude of the voltage between the baseline voltage and the plateau voltage of the basic waveform.

40. A method comprising forming jetting waveform trimming information corresponding to respective inkjets of an inkjet print head module for respective jetting cycles, sending the jetting waveform trimming information from an external location to storage located on the inkjet print head module, modifying a basic waveform based on the jetting waveform trimming information to generate jetting waveforms, wherein:

the basic waveform comprises a baseline voltage and a plateau voltage that are separated from each other by a voltage having a relative magnitude, the baseline voltage of the basic waveform preceding the plateau voltage of the basic waveform;

for each jetting waveform, the jetting waveform comprises a baseline voltage and a plateau voltage that are separated from each other by a voltage having a relative magnitude, the baseline voltage of the jetting waveform preceding the plateau voltage of the jetting waveform; and modifying the basic waveform to generate the jetting waveforms comprises reducing the relative magnitude of the voltage between the baseline voltage and the plateau voltage of the basic waveform by increasing the baseline voltage so that, for each jetting waveform, the relative magnitude of the voltage between the baseline voltage and the plateau voltage of the jetting waveform is less than the relative magnitude of the voltage between the baseline voltage and the plateau voltage of the basic waveform by a trimming amount; and for each jetting waveform, applying its plateau voltage to its corresponding inkjet causes the corresponding inkjet to jet an ink drop, and sending jetting cycle trigger signals from an external location to the inkjet print head module to trigger successive jetting cycles in each of which jetting waveforms based on the jetting waveform trimming information are applied to the respective inkjets.

41. The method of claim 40 in which the jetting waveform trimming information is generated based on information about ink drops to be jetted from the respective inkjets.

42. The method of claim 41 in which the information about ink drops is generated empirically.

43. The method of claim 40 in which the jetting waveform trimming information comprises nominal trimming values representing different respective amounts of trimming.

44. The method of claim 40 in which the jetting waveform trimming information comprises trimming amounts representing respective different amounts of voltage by which to trim jetting waveforms.

45. The method of claim 40 in which the jetting waveform trimming information includes separate information for each of the inkjets for each of the jetting cycles.

46. The method of claim 40 in which the jetting waveform trimming information includes separate information for respective sets of the inkjets.

47. The method of claim 40 in which at least some of the jetting waveform trimming information is sent to the storage located on the inkjet print head module at least as often as each print job.

48. The method of claim 40 in which at least some of the jetting waveform trimming information is sent to the storage located on the inkjet print head module from time to time.

49. The method of claim 40 in which the jetting waveform trimming information comprises a lookup table that associates nominal trimming values with amounts of trimming voltage.

50. A method comprising modifying a basic waveform to generate jetting waveforms, wherein:

the basic waveform comprises a baseline voltage and a plateau voltage that are separated from each other by a voltage having a relative magnitude, the baseline voltage of the basic waveform preceding the plateau voltage of the basic waveform;

for each jetting waveform, the jetting waveform comprises a baseline voltage and a plateau voltage that are separated from each other by a voltage having a relative magnitude, the baseline voltage of the jetting waveform preceding the plateau voltage of the jetting waveform; and modifying the basic waveform to generate the jetting waveforms comprises reducing the relative magnitude of the voltage between the baseline voltage and the plateau voltage of the basic waveform by increasing the baseline voltage so that, for each jetting waveform, the relative magnitude of the voltage between the baseline voltage and the plateau voltage of the jetting waveform is less than the relative magnitude of the voltage between the baseline voltage and the plateau voltage of the basic waveform by a trimming amount; and for each jetting waveform, applying its plateau voltage to its corresponding inkjet causes the corresponding inkjet to jet an ink drop, and enabling different jetting waveforms to be applied to different inkjets of an inkjet head module to improve the uniformity of jetting among the inkjets.

51. The method of claim 50 in which the jetting waveforms are generated from an integrated circuit.

* * * * *

UNITED STATES PATENT AND TRADEMARK OFFICE

CERTIFICATE OF CORRECTION

PATENT NO. : 8,926,041 B2
APPLICATION NO. : 13/751814
DATED : January 6, 2015
INVENTOR(S) : Timothy Rosario, Jaan T. Laaspere and George Baker It is certified that error appears in the above-identified patent and that said Letters Patent is hereby corrected as shown below:

On the Title page

Item (71) Applicants, delete "Timothy Rosario, Enfield, NH (US); Jaan T. Laaspere, Norwich, VT (US); George Baker, Charlestown, NH (US)" and insert -- FUJIFILM Dimatix, Inc. --

In the Claims

Column 12, Line 30, In Claim 21, delete "non jetting" and insert -- non-jetting --

Signed and Sealed this
Second Day of June, 2015

Michelle K. Lee

Michelle K. Lee
*Director of the United States Patent and Trademark Office*